US006107587A

United States Patent [19]

Itoh et al.

[11] Patent Number: 6,107,587

[45] Date of Patent: Aug. 22, 2000

[54] MULTIPLE PASS SHEET SORTER WITH AUTOMATIC RETURN

[75] Inventors: Minoru Itoh; Kazuhito Yoshitani, both of Tokyo, Japan

[73] Assignee: NEC Corporation, Tokyo, Japan

[21] Appl. No.: 08/815,117

[22] Filed: Mar. 11, 1997

[51] Int. Cl.[7] ..... B07C 5/36

[52] U.S. Cl. ..... 209/583; 209/584

[58] Field of Search ..... 209/583, 584; 271/312, 305, 306, 307

[56] References Cited

U.S. PATENT DOCUMENTS

| | | | |
|---|---|---|---|
| 4,106,636 | 8/1978 | Ouimet et al. | 214/11 R |
| 5,097,959 | 3/1992 | Tilles et al. | 209/584 |
| 5,353,938 | 10/1994 | LaGrange et al. | 209/584 |
| 5,363,971 | 11/1994 | Weeks et al. | 209/585 |
| 5,421,464 | 6/1995 | Gillmann et al. | 209/584 |
| 5,593,044 | 1/1997 | Yamashita et al. | 209/584 |
| 5,607,063 | 3/1997 | Nishijima et al. | 209/584 |
| 5,667,078 | 9/1997 | Walach | 209/584 |
| 5,740,921 | 4/1998 | Yamashita et al. | 209/584 |
| 5,749,473 | 5/1998 | Yamashita et al. | 209/584 |
| 5,810,174 | 9/1998 | Hamada et al. | 209/584 |

FOREIGN PATENT DOCUMENTS

| | | | |
|---|---|---|---|
| 0 718 049 A2 | 6/1996 | European Pat. Off. | B07C 3/06 |
| 43 02 231 A1 | 8/1994 | Germany | B07C 3/02 |
| 8-66661 | 3/1996 | Japan . | |

*Primary Examiner*—Christopher P. Ellis
*Assistant Examiner*—Patrick Mackey
*Attorney, Agent, or Firm*—Foley & Lardner

[57] ABSTRACT

A multiple pass sheet sorter in which supplied sheets are automatically sorted in multiple passes. The sheets are sorted into classifying boxes such that the assignment of sheets to classifying boxes in the second and subsequent passes are automatically adjusted based on a classification information added to the sheets and with reference to a stacking order table and a classifying box assignment table.

10 Claims, 6 Drawing Sheets

201

21 22

| MACHINE CODE | ORDER INFORMATION |
| --- | --- |
| 10602 | 001 |
| 10603 | 002 |
| • | • |
| • | • |
| • | • |

FIG. 3

202a

| ORDER INFORMATION (22) | CLASSIFYING BOX NUMBER (23) |
|---|---|
| * * 0 | 0 |
| * * 1 | 1 |
| * * 2 | 2 |
| * * 9 | 9 |

F I G. 4

202b

| ORDER INFORMATION (22) | CLASSIFYING BOX NUMBER (23) |
|---|---|
| * 0 * | 0 |
| * 1 * | 1 |
| * 2 * | 2 |
| * 3 * | 3 |
| * 9 * | 9 |

FIG. 5 A

202b'

| ORDER INFORMATION (22) | CLASSIFYING BOX NUMBER (23) |
|---|---|
| * 0 * | 0 |
| * 1 * | |
| * 2 * | 1 AND 2 |
| * 3 * | 3 |
| * 9 * | 9 |

FIG. 5 B

203

| ORDER INFORMATION | NUMBER OF SHEETS |
|---|---|
| * 0 * | X X |
| * 1 * | 0 |
| * 2 * | Y Y |
| * 3 * | |
| * 4 * | |
| * 5 * | |
| * 6 * | |
| * 7 * | |
| * 8 * | |
| * 9 * | |

F I G. 6

MULTIPLE PASS SHEET SORTER WITH AUTOMATIC RETURN

BACKGROUND OF THE INVENTION

The present invention relates to a sheet classifying apparatus and method that perform so-called rearrangement of mailpieces, i.e., rearrange a plurality of sheets, and in particular, mailpieces, in order based on classification information by classifying and stacking the sheets in classifying boxes corresponding to the classification information added to the surfaces of the sheets or mailpieces.

In a mail delivery system, first, the mailpieces are classified in units of destination areas based on the recognition results of postal codes written/printed on the surfaces of the mailpieces to correspond to the destination areas (the first classifying operation). After the mailpieces are classified, they are rearranged, in accordance with the addresses and the like written/printed on the mailpieces, in the delivery route order with which the mailpieces are delivered (the second classifying operation).

In a conventional mail delivery system, as disclosed in, e.g., AUTOMATION AND RETAIL EQUIPMENT, March 1992, the stage of classifying the mailpieces is units of destination areas as the first classifying operation is performed automatically by using, e.g., a bar code sorter. After the mailpieces are classified in units of destination areas, they are rearranged manually in the delivery order. With this method of rearranging the mailpieces manually, rearrangement is hard to eliminate errors, and is cumbersome and time-consuming. From these reasons, it is requested that the operation of classifying the mailpieces and rearranging them in the delivery order (to be referred to as rearrangement hereinafter) be performed entirely automatically.

A sheet classifying apparatus that performs this rearrangement is proposed in Japanese Patent Laid-Open No. 8-66661.

In this proposed sheet classifying apparatus, first, paper sheets sent one by one from a supply section are classified and stacked in accordance with classification information in a plurality of classifying boxes having feed-out mechanisms. After the first classifying operation is ended, the sheets that are fed out in the stacked state from the respective classifying boxes continuously in a predetermined classifying box order are reset in the supply section. The sheets set in the supply section are fed out again one by one, and are classified and stacked in the classifying boxes in accordance with classification information. These operations are repeated until rearrangement is completed. If a classifying box in which classified sheets are to be stacked is full, the sheets are classified and stacked in an overflow classifying box.

In the sheet classifying apparatus described above, the pieces of classification information are assigned to the respective classifying boxes such that the sheets are classified and stacked in the corresponding classifying boxes in accordance with the pieces of classification information, without considering the numbers of sheets to be stacked in the respective classifying boxes.

Therefore, in the second classifying operation, if the count of sheets to be classified in the first classifying box is 0 and the number of sheets to be classified in the second classifying box is large, despite that the first classifying box is empty, overflow occurs in the second classifying box.

SUMMARY OF THE INVENTION

It is an object of the present invention to provide a sheet classifying apparatus and method in which overflow from a classifying box is prevented.

In order to achieve this object, according to the present invention, there is provided a sheet classifying apparatus comprising supply means for supplying a plurality of sheets set in units of classifying operations to a convey route one by one, detection means for reading classification information added to the sheets, a plurality of classifying boxes in which a predetermined number of sheets conveyed on the convey route are stacked, reset means for automatically resetting the sheets in the classifying boxes in the supply means in accordance with a predetermined classifying box order, thereby preparing for a second and following classifying operations, adjusting means for adjusting, in the second and following classifying operations, a relationship between the sheets and the classifying boxes assigned as sheet stacking destinations based on the classification information read by the detection means in the first classifying operation, and control means for determining the classifying boxes where the sheets are to be stacked based on the classification information read by the detection means and an adjustment result of the adjusting means, thereby controlling a classifying operation.

BRIEF DESCRIPTION OF THE DRAWINGS

FIG. 3 is a table showing the relationship between the machine codes of a stacking order table shown in FIG. 2 and order information;

FIG. 4 is a table showing the relationship between the order information of the first table of a classifying box assignment table shown in FIG. 2 and the classifying box numbers;

FIG. 5A is a table showing the relationship between the order information of the second table of the classifying box assignment table shown in FIG. 2 and the classifying box numbers, and FIG. 5B is a table showing the relationship between the updated order information of the second table shown in FIG. 5A and the classifying box numbers; and FIG. 6 is a table showing the relationship between the order information stored in a memory shown in FIG. 2 and the number of sheets.

DESCRIPTION OF THE PREFERRED EMBODIMENT

The present invention will be described in detail with reference to the accompanying drawings.

Figure 1:
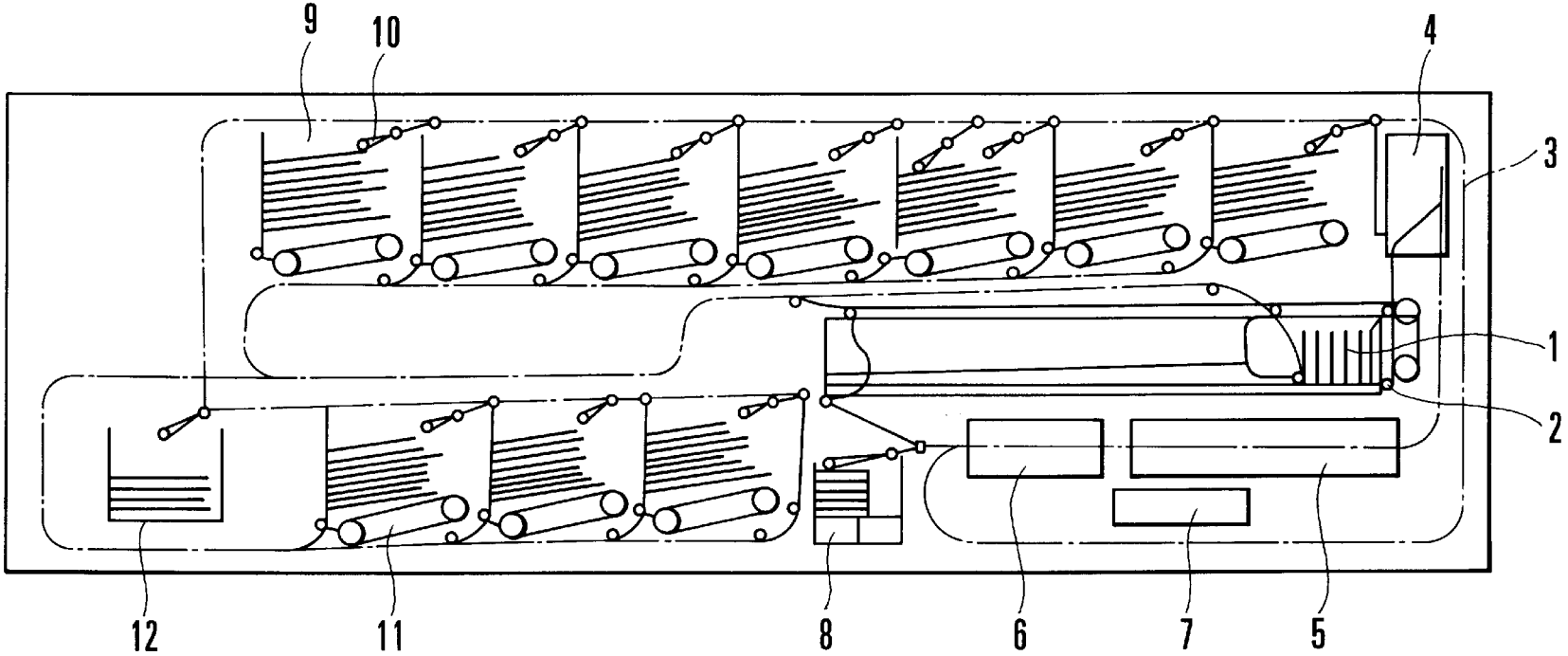
FIG. 1 is a schematic diagram showing the arrangement of a sheet classifying apparatus according to an embodiment of the present invention.

FIG. 1 shows the arrangement of a sheet classifying apparatus according to an embodiment of the present invention. Pieces of classification information are added to the surfaces of a plurality of sheets 1 which are to be rearranged, and these sheets 1 are collectively set in a supply section 2. The pieces of classification information are, e.g., the postal code or address written/printed on the surface of the mailpiece, or a code (e.g., a bar code) indicating such information. More specifically, the classification information designates the destination area of the mailpiece and the delivery order (to be referred to as order information hereinafter) of the mailpiece in this designation area.

The sheets 1 set in the supply section 2 are fed one by one with a supply means, e.g., a suction belt, to a convey route 3 (indicated by an alternate long and short dashed line in FIG. 1). The sheets 1 supplied one by one from the supply section 2 are supplied to a detecting section 6 through a switch-back section 4 and an aligning section 5. The switch-back section 4 switches the convey direction of the sheets 1 in order to align the direction of the sheets 1 when being fed out from the supply section 2 with the direction of the sheets 1 when being stacked in the supply section 2. The aligning section 5 eliminates a skew in the convey direction of the sheets 1 in the supply section 2 and the switch-back section 4.

The detecting section 6 reads the classification information added to the surface of a sheet 1 under conveyance, and the classification information is sent to a control section 7 as a machine code. During reading, a sheet 1 detected as unreadable or a sheet 1 which is not a classifying target is classified in a rejection classifying box 8. The control section 7 refers to a classifying box assignment table (to be described later) in accordance with order information corresponding to the read classification information, thereby determining in which one of classifying boxes 9 the sheet 1 in question is to be classified. More specifically, the control section 7 transmits a switching control signal to a course selector 10 provided to the determined classifying box 9. The course selector 10 is turned on/off by this control signal to branch the sheet 1 in question from the convey route 3 and to drop it in the corresponding classifying box 9. When all the sheets 1 set in the supply section 2 are classified and stacked in the classifying boxes 9 corresponding to the classification information attached to them, the first classifying operation is ended.

In the second classifying operation, first, feed-out mechanisms 11 are driven to feed the sheets 1 stacked in the respective classifying boxes 9 in the first classifying operation to the convey route 3 in a predetermined classifying box order. The fed sheets 1 are reset in the supply section 2 and is fed one by one to the convey route 3 in the second classifying operation. The fed sheets 1 are subjected to an operation identical to the first classifying operation described above, so that they are classified in the corresponding classifying boxes 9 again. The second classifying operation is identical to the first classifying operation, and a detailed description thereof will thus be omitted. When all the sheets 1 reset in the supply section 2 are classified and stacked in the corresponding classifying boxes 9 in this manner, the second classifying operation is ended.

When the operation described as the second classifying operation is repeated, classification can be performed an arbitrary number of times in accordance with the number of sheets to be rearranged, i.e., in accordance with the number of digit positions of the order information. If an assigned classifying box 9 is already full, the sheet 1 is stacked in an overflow box 12.

The characteristic feature of the present invention resides in the assignment of the classifying boxes 9 by the control section 7, and in particular in the assignment of the classifying boxes 9 in the second and following classifying operations.

Figure 2:
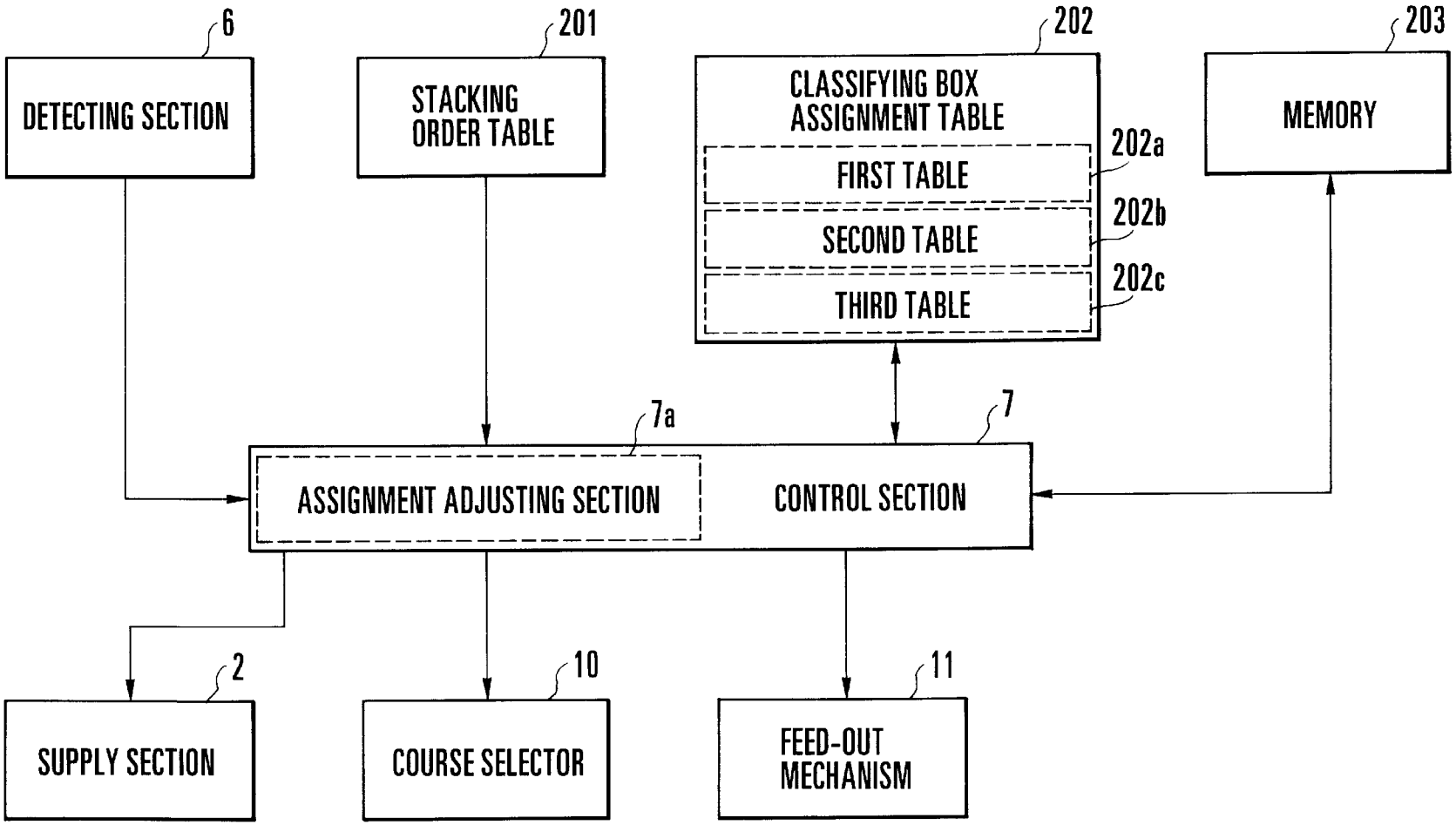
FIG. 2 is a block diagram showing the arrangement of the sheet classifying apparatus shown in FIG. 1.

FIG. 2 shows the arrangement of the sheet classifying apparatus shown in FIG. 1, in which reference numeral 7*a* denotes an assignment adjusting section; 201, a stacking order table; 202, a classifying box assignment table; and 203, a memory. The assignment adjusting section 7*a* is provided to the control section 7 to adjust assignment of the classifying boxes 9. A relationship between machine codes and order information is set in the stacking order table 201. A relationship between the order information and the classifying box numbers is set in the classifying box assignment table 202. The number of sheets in units of classifying boxes is stored in the memory 203 in accordance with the detection result. The classifying box assignment table 202 has a first table 202*a* which is referred to in the first classifying operation, a second table 202*b* which is referred to in the second classifying operation, and a third table 202*c* which is referred to in the third classifying operation. The number of sheets is the number of sheets 1 to be classified in a classifying box 9 defined by the order information. In other words, the number of sheets is the number of sheets 1 to be stacked in one classifying box 9.

Referring to FIG. 2, the classification information added to the sheet 1 is read by the detecting section 6, and a machine code is sent to the control section 7 as the detection. The control section 7 refers to the stacking order table 201 to obtain order information corresponding to the sent machine code. In the stacking order table 201, pieces of order information 22 are set to correspond to machine codes 21, as shown in FIG. 3. Subsequently, the control section 7 refers to the classifying box assignment table 202 to obtain a classifying box number corresponding to the order information 22 obtained from the stacking order table 201. As shown in FIG. 4, in the classifying box assignment table 202, the relationship between the order information 22 and a classifying box number 23 of a classifying box to which the sheet having this order information 22 should be classified is set in each of the first to third tables 202*a*, 202*b*, and 202*c* in units of classifying operations.

Based on the registered contents of the stacking order table 201 and classifying box assignment table 202, the control section 7 determines the classifying box 9 to which a sheet 1 whose classification information is read by the detecting section 6 should be classified, as described above, and controls the course selector 10 provided to this classifying box 9 in accordance with this determination result. The sheet 1 under conveyance on the convey route 3 is then classified and stacked in one of the classifying boxes 9 determined by the control section 7. At this time, the control section 7 stores, in the memory 203, the numbers of sheets to be stacked in the respective classifying boxes 9 in accordance with the digits of the respective digit positions of the order information. In other words, the numbers of sheets 1 to be stacked in the respective classifying boxes 9 in units of classifying operations are stored in the memory 203.

In the second and following classifying operations, the assignment adjusting section 7*a* of the control section 7 refers to the memory 203 to adjust assignment of the classifying boxes 9 in units of classifying operations.

An operation will be described wherein the pieces of order information corresponding to the pieces of classification information added to the sheets 1 are defined as "000" to "999" and that these sheets 1 are to be rearranged in the order indicated by the order information by using ten classifying boxes 9 added with numbers 0 to 9.

In the first classifying operation, the first table 202*a* of the classifying box assignment table 202 is referred to to obtain the classifying box number 23 of a classifying box corresponding to the order information 22 obtained from the stacking order table 201. In the first table 202*a*, as shown in FIG. 4, numbers equal to the digits of the unit's places of the pieces of order information 22 are assigned to the corresponding classifying boxes as their classifying box numbers 23. The control section 7 classifies and stacks each sheet 1 in the classifying box 9 corresponding to the digit of the unit's place of its order information 22 in accordance with the classifying box number 23 of the classifying box obtained from the first table 202*a*. Simultaneously, every time order information is obtained from the stacking order table 201, the control section 7 stores the obtained order information in the memory 203.

When all the sheets 1 set in the supply section 2 are classified and stacked in the corresponding classifying boxes 9 in accordance with the digits of the unit's places of their order information 22, the first classifying operation is ended.

Subsequently, the feed-out mechanisms 11 provided to the respective classifying boxes 9 are operated to automatically reset all the sheets 1 in the supply section 2 in a predetermined classifying box order, and thereafter the second classifying operation is started. For example, in the supply section 2, the sheets 1 are reset in the order of "0", "1", "2", . . . , and "9" from above.

In the second classifying operation, pieces of classifying box assignment information are initially registered in the second table 202*b* of the classifying box assignment table 202, as shown in FIG. 5A. More specifically, numbers equal to the digits of the ten's places of the pieces of order information 22 are assigned to the corresponding classifying boxes 9 as their classifying box numbers 23. When, however, the numbers of sheets corresponding to the respective pieces of order information in the second classifying operation stored in the memory 203 shown in FIG. 6 are referred to, overflow occurs in sheets with pieces of order information whose digits in the ten's places are "2". More specifically, the number of sheets with pieces of order information whose digits in the ten's places are "0" is "XX", which is equal to or less than the capacity of the corresponding classifying box 9, and the number of sheets with pieces of order information whose digits in the ten's places are "1" is "0". Meanwhile, the number of sheets with pieces of order information whose digits in the ten's places are "2" is "YY", which exceeds the capacity of the corresponding classifying box 9. It is thus apparent that overflow occurs in a classifying box 9 with the number "2".

Therefore, the assignment adjusting section 7*a* of the control section 7 updates the second table 202*b* shown in FIG. 5A to a second table 202*b*' as shown in FIG. 5B. More specifically, the second table 202*b* is updated such that sheets 1 with pieces of order information whose digits in the ten's places are "1" are not assigned to the original classifying box 9 but are assigned to two classifying boxes 9 designed to store the sheets 1 with pieces of order information whose digits in the ten's places are "2". In this case, the classifying boxes 9 whose classifying box numbers 23 are "1" and "2" are assigned as common classifying boxes to store sheets 1 with pieces of order information whose digits in the ten's places are "2".

In FIG. 6, in place of the number of sheets with pieces of order information whose digits in the ten's places are "1", if the number of sheets with pieces of order information whose digits in the ten's places are "0" is "0", the sheets 1 with pieces of order information whose digits in the ten's places are "0" are not assigned to the original classifying box 9 in FIG. 5B, but the sheets 1 with pieces of order information whose digits in the ten's places are "1" may be assigned to the classifying box 9 whose classifying box number 23 is "0".

When the classifying operation is performed in the same manner as described above by using the updated second table 202*b*', the sheets 1 with pieces of order information whose digits in the ten's places are "2" are stacked in the second classifying box 9 when the first classifying box 9 is full, so that overflow is prevented.

In the third classifying operation, the third table 202*c* of the classifying box assignment table 202 is initialized so that the classifying boxes 9 are assigned in accordance with the digits in the hundred's places of the stacking order of the respective sheets. In the third classifying operation as well, the assignment adjusting section 7*a* of the control section 7 refers to the memory 203 to update the third table 202*c*. More specifically, the number of classifying boxes to be assigned is adjusted in accordance with the number of sheets, obtained by the first classifying operation, to be stacked in each classifying box 9, thereby preventing overflow.

When the third classifying operation is ended, the sheets 1 have been classified in the corresponding classifying boxes 9 in accordance with the order of pieces of order information "000" to "999".

As has been described above, with the sheet classifying apparatus and method according to the present invention, based on information obtained in the first classifying operation, the number of classifying boxes to be assigned to each order information is adjusted in the second and following classifying operations. As a result, overflow can be prevented, and efficient rearrangement can be performed.

What is claimed is:

1. A sheet sorting apparatus comprising:

a plurality of boxes in each of which a predetermined number of sheets can be stacked without overflowing;

supply means for supplying a plurality of sheets to a convey route one by one;

detection means for reading classification information added to each of the sheets, the classification information indicating for each sheet a particular destination box in which said sheet is to be stacked;

branching means for diverting each sheet in the convey route into one of the boxes;

reset means for automatically resetting the sheets that have been stacked in said boxes to said supply means;

means for determining if the number of sheets to be stacked in a particular box exceeds the capacity of that particular box and, if so, identifying an additional destination box in which said sheets are to be stacked; and control means for controlling the branching means to divert each sheet into a particular box, wherein, during the first pass, the control means controls the branching means to divert each sheet into a particular box based on the classification information and, during the second pass, the control means controls the branching means to divert each sheet into either a particular box based on the classification information or, when necessary, into said additional destination box.

2. An apparatus according to claim 1, further comprising:

storage means for storing, for each box, the number of sheets that are to be stacked therein, and wherein said means for determining refers to said storage means when identifying said additional destination box.

3. A sheet sorting apparatus comprising:

a plurality of boxes each identified by a box code and in each of which a predetermined number of sheets can be stacked without overflowing;

supply means for supplying a plurality of sheets to a convey route one by one;

detection means for reading classification information added to each of the sheets;

branching means for diverting each sheet in the convey route into one of the boxes;

reset means for automatically resetting the sheets that have been stacked in said boxes to said supply means;

means for determining if the number of sheets to be stacked in a particular box exceeds the capacity of that particular box and, if so, identifying additional destination box in which said sheets are to be stacked;

control means for controlling the branching means to divert each sheet into a particular box;

a stacking order table in which a relationship between the classification information of the sheets and an order information of the sheets is defined; and a box assignment table in which a relationship between the order information of the sheets and the box codes is defined, wherein, for each sheet, said control means refers to the classification information of said sheet, said stacking order table , and said box assignment table to determine a destination box for said sheet and controls the branching means to divert said sheet into said destination box, and wherein, during the first pass, the control means controls the branching means to divert each sheet into the destination box as determined from the classification information of said sheet, the stacking order table, and the box assignment table, and during the second pass, the control means controls the branching means to divert each sheet into either the destination box as determined from the classification information of said sheet, the stacking order table, and the box assignment table or, when necessary, to said additional destination box.

4. An apparatus according to claim 3, further comprising:

means for updating the relationship between the order information of the sheets and the box codes defined in the box assignment table for use during the second pass, wherein said control means refers to said updated box assignment table to determine the destination boxes for the sheets.

5. A sheet classifying method comprising the steps of:

(a) setting a plurality of sheets added with classification information that designates destination boxes for the sheets;

(b) sending out the sheets onto a convey route one by one;

(c) reading the classification information of each sheet sent out onto said convey route;

(d) stacking the sheets in their respective destination boxes as designated by the classification information;

(e) automatically resetting the sheets that are stacked in said boxes;

(f) determining the number of sheets to be stacked in each of the destination boxes as designated by the classification information;

(g) if the number of sheets to be stacked in any one destination box as determined in step (f) exceeds the capacity of that destination box, assigning an additional destination box to said sheets;

(h) sending out the sheets that have been reset onto said convey route one by one; and (i) stacking the sheets in one of said destination boxes and when necessary to said additional destination box.

6. A method according to claim 5, wherein the step of adjusting further includes the step of adjusting the numbers of said classifying boxes assigned as sheet classifying destinations.

7. An apparatus according to claim 3, wherein the box code comprises a box number.

8. A method according to claim 5, further comprising the step of stacking some of the sheets in an overflow box if, during the step (d) of stacking, the number of sheets stacked in any one destination box exceeds the capacity of that destination box.

9. A method according to claim 5, wherein the step (g) of assigning includes the step of updating a destination box assignment table which specifies the assignments of the destination boxes for all the sheets.

10. A method according to claim 9, further comprising the step of revoking an assignment of a destination box if the number of sheets to be stacked in that destination as determined in step (f) is zero.

* * * * *